US009821247B1

(12) United States Patent
Hodges et al.

(10) Patent No.: US 9,821,247 B1
(45) Date of Patent: Nov. 21, 2017

(54) BOOK PAGE WITH MOVING STRUCTURE

(71) Applicant: COTTAGE DOOR PRESS, LLC, Barrington, IL (US)

(72) Inventors: Angela M. Hodges, Oak Park, IL (US); Virginia G. O'Donnell, Chicago, IL (US)

(73) Assignee: Cottage Door Press, LLC, Barrington, IL (US)

( * ) Notice: Subject to any disclaimer, the term of this patent is extended or adjusted under 35 U.S.C. 154(b) by 0 days.

(21) Appl. No.: 15/339,014

(22) Filed: Oct. 31, 2016

(51) Int. Cl.
*A63H 33/38* (2006.01)
*B42D 1/00* (2006.01)
*B42D 3/06* (2006.01)

(52) U.S. Cl.
CPC ..... *A63H 33/38* (2013.01); *B42D 1/006* (2013.01); *B42D 3/06* (2013.01)

(58) Field of Classification Search
CPC .. A63H 33/38; B42D 3/00; B42D 3/06; G09F 1/06; G09F 1/08
See application file for complete search history.

(56) References Cited

U.S. PATENT DOCUMENTS 384,697 A 6/1888 Kelly
1,519,610 A * 12/1924 Franz, Jr. ..... B42D 3/045 229/117.09
2,852,275 A 9/1958 Brook
3,995,388 A * 12/1976 Penick ..... G09F 1/06 40/124.08
4,164,085 A 8/1979 Steeb et al.
5,055,084 A * 10/1991 Jokic ..... A63H 13/16 40/539
D335,305 S 5/1993 Burns
5,257,823 A 11/1993 Colvin, Jr. et al.
5,472,240 A * 12/1995 Davies ..... B42D 15/042 156/250
5,564,208 A * 10/1996 Bergman ..... G09F 1/08 40/124.08
D460,482 S 7/2002 Nomura
6,951,352 B1 10/2005 Hyde
7,137,752 B2 11/2006 Hendee
D575,334 S 8/2008 Verhouden
D617,831 S 6/2010 Scroggins
8,341,862 B1 1/2013 Gunther
8,661,719 B2 3/2014 Hughes et al.
(Continued)

OTHER PUBLICATIONS

Richard G. Maddrell et al., Book With Greeting Card Cover, filed Dec. 30, 2015, U.S. Appl. No. 14/984,134.
(Continued)

*Primary Examiner* — John Ricci
(74) *Attorney, Agent, or Firm* — Pauley Erickson & Kottis

(57) ABSTRACT

A book having a plurality of pages bound together to form the book. At least one page of a spread of the book has a flap movable with respect to the page. The flap has a flap recess. The page has a page recess. In a closed position, the flap is positioned within the page recess. A structural element, such as a pop-up element, is housed within the flap recess and/or the page recess. As the flap moves from the closed position to an open position, the structural element moves or raises above the page surface to move the structural element into an activated position. In the closed position, the structural element is hidden from view when looking at the page.

17 Claims, 1 Drawing Sheet

(56) References Cited

U.S. PATENT DOCUMENTS

| | | | |
|---|---|---|---|
| D769,970 | S | 10/2016 | Hodges et al. |
| 2004/0012190 | A1 | 1/2004 | D'Andrea |
| 2011/0181624 | A1 | 7/2011 | Nugara |
| 2016/0236502 | A1 | 8/2016 | Maddrell et al. |

OTHER PUBLICATIONS http://cottagedoorpress.com, Cottage Door Press, "Little Bird Greetings TM—Bless this Child," Product Description, Cottage Door Press Company Webstie. Jan. 19, 2015 (4 pp).

* cited by examiner

BOOK PAGE WITH MOVING STRUCTURE

BACKGROUND OF THE INVENTION

Field of the Invention

This invention relates to a book, such as a book for children, having a flap that moves with respect to a page of the book and as the flap moves between a closed position and an open position the movement activates or moves a pop-up type of structural element contained or housed within the page itself.

Discussion of Related Art

Many conventional books that have relatively thick pages, such as books for children, have structural elements that are attached to two different pages of a spread of the book. When the conventional book is closed, the structural element is positioned across the two different pages and when the conventional book is opened so that the two pages of the spread are visible, the structural element elevates or raises above the surface of the two pages. Because the entire structural element is positioned between the two pages on conventional books, the material thickness of the structural element needs to be relatively thin and thus can be easily broken and detached, for example, by children simply using and playing with the book.

There is an apparent need for a book, particularly a book for children which has relatively thick pages, having a sturdy structural element pop-up, lift-up or otherwise move from a hidden position when a flap of a page of the book is closed to a visible position when the flap is opened and moved relative to the page of the book.

SUMMARY OF THE INVENTION

A book according to this invention has pages bound together that form the book, according to binding methods and systems known to those skilled in the art of publishing and manufacturing books. The books of this invention have a spread formed by two adjacent or bound pages and a flap is movably attached with respect to one of the pages. The flap moves between an open position and a closed position with respect to the page. A structural pop-up element is positioned or mounted within the page itself, such as between the flap and the page.

In some embodiments of this invention, the flap has a recess that houses or contains the structural pop-up element. In some embodiments, the structural pop-up element is visibly hidden when the flap is in the closed position and moves to a visible activated position when the flap is moved to the open position. The flap can be moved in any direction relative to the page or the book. Movement of the flap can occur by or through a hinged connection, a sliding connection and/or any other suitable connection that allows the flap to move with respect to the page of the book.

By housing the structural element between the flap and the page and also within at least one recess in the flap and/or the page, it is possible to vary the dimensions of the recesses so that the structural element can be made of a relatively rigid material, such as relatively heavier or thicker cardboard, paper board or other suitable sheet material. With the relatively heavier sheet material, it is possible to more permanently anchor or secure the structural element to the flap and/or the page, for example, so that a child playing with the structural element cannot easily tear or detach the structural element from the page of the book.

BRIEF DESCRIPTION OF THE DRAWINGS

Features of this invention can be better understood when this specification is read or taken in view of the drawings, wherein.

DETAILED DESCRIPTION OF THE INVENTION

In some embodiments according to this invention, a structural element, such as a pull-up element, a pop-up element and/or a pull-to-activate element, is activated, positioned and/or otherwise moved, for example, to raise, elevate and/or otherwise move the structural element to a position above a page of a book. Many technical features of a book, such as a children's book, are described in United States Patent Application Publication US 2016/0236502 A1, the entire teachings of which are incorporated into this specification by reference thereto.

Figure 1:
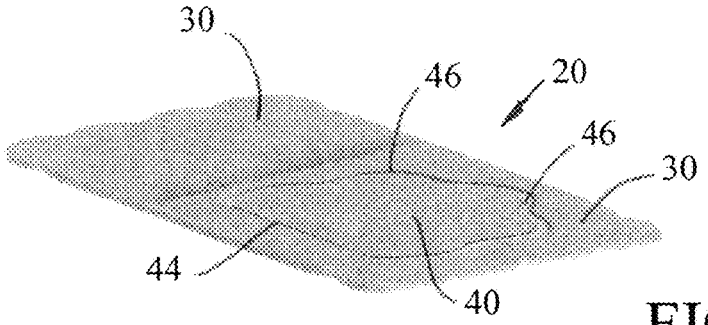
FIG. 1 is a top front perspective view of a book with a flap and a pop-up element within a page of the book, with the flap in a closed position, according to one embodiment of this invention.
Figure 2:
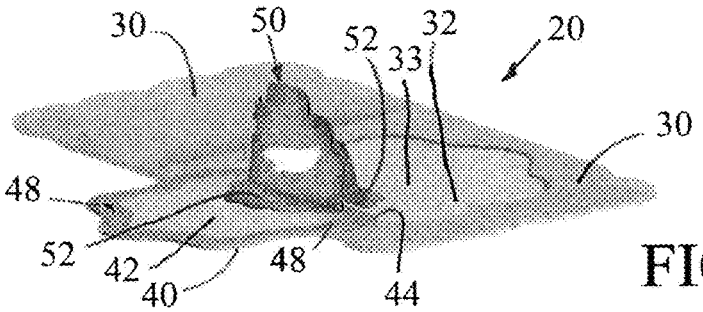
FIG. 2 is a top front perspective view of the book with the flap and the pop-up element, as shown in FIG. 1, but with the flap in an open position.

FIGS. 1 and 2 show book 20 having two pages 30 or leafs, and two pages 30 are often referred to as a spread. In some embodiments of this invention, book 20 has a plurality of individual pages 30 and/or a different number of multiple pages 30. According to different embodiments of this invention, book 20 has a generally rectangular overall shape, a square overall shape or any other suitable overall shape.

Each page 30 of book 20 can be bound by any suitable binding structure and/or binding material and/or method known to those skilled in the art of publishing and printing. In some embodiments of this invention, pages 30 are bound so that they can open with respect to each other to show or reveal content on different pages or spreads. In some embodiments of this invention, each page 30 is relatively thick, which is commonly found in books for children. In other embodiments of this invention, page 30 can have any other suitable thickness, thicker or thinner, depending upon the particular use. Each page 30 can be constructed of paper, cardboard, a polymeric material, a fabric material and/or any other suitable material for the book, depending upon the use.

Each page 30 can have a similar overall or peripheral shape compared to the overall or peripheral shape of a cover of book 20, or can have a different overall or peripheral shape. In some embodiments of this invention, the thickness of the cover is approximately the same as the thickness of each page 30, but in other embodiments of this invention the thickness of the cover and/or the back can be different.

As shown in FIGS. 1 and 2, book 20 comprises or includes flap 40 which is movable with respect to page 30 and/or with respect to any other part of book 20. FIG. 1 shows flap 40 in a closed position and in some embodiments of this invention flap 40 is at a first distance from page 30 which is relatively closer than a second distance shown in the open position of FIG. 2, between flap 40 and page 30. FIG. 1 shows flap 40 in a closed position with respect to page 30. In moving from the position shown in FIG. 1 to the position shown in FIG. 2, flap 40 opens with respect to page 30. In some embodiments of this invention, flap 40 opens with respect to page 30 and thus flap 40 moves to activate, pull and/or otherwise move structural element 50, and in some embodiments of this invention causes or results in structural element 50 moving to a pop-up position, a pull-up position and/or an activated position, such as shown in FIG. 2, as flap 40 is moved into the open position.

Figure 4:
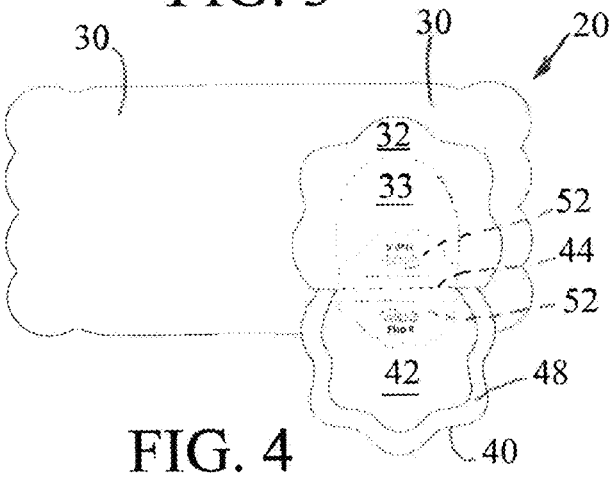
FIG. 4 is a top view of the book with the flap and the pop-up element, as shown in FIG. 2.

According to some embodiments of this invention, book 20 has a plurality of pages 30 bound together to form book 20, and a first page 30 having or forming recess 32, such as shown in FIGS. 2 and 4. In some embodiments of this invention, such as shown in FIGS. 2 and 4, page 30 has recess 32 with a further or deeper recess 33 formed as part of and/or positioned adjacent to recess 32. In some embodiments of this invention, at least a portion or all of structural element 50 fits or is positioned within recess 33. In different embodiments, dimensions or thicknesses of recesses 32, 33 and/or 42 can be varied so that in the closed position at least a portion or all of structural element 50 is positioned within only recess 33 or within only recess 42. In other embodiments, in the closed position, all of structural element 50 is positioned within only recess 42 of flap 40.

Figure 5:
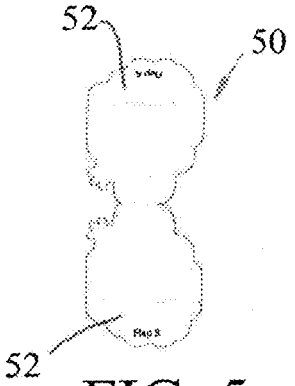
FIG. 5 is a top view of a structural element, according to one embodiment of this invention.

In some embodiments according to this invention, flap 40 is movable with respect to page 30 between the open position and the closed position. In some embodiments of this invention, structural element 50 forms a pop-up element, a pull-up element and/or a pull-to-activate element. In some embodiments of this invention, structural element 50 has a relatively sturdy or substantial structure, such as formed by cardboard, fiberboard and/or any other relatively strong material. With the relatively stronger material, it is more difficult to accidentally or unintentionally detach or remove structural element 50 from its attachment to page 30. In some embodiments of this invention, such as shown in FIGS. 2, 4 and 5, tabs 52 are secured to page 30 and/or to flap 40, with an adhesive, a fastener, an attachment and/or any other device or method used to secure tabs 52 to page 30 or to flap 40.

Figure 6:
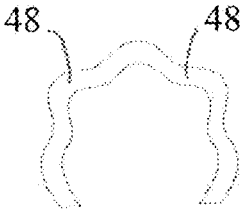
FIG. 6 is a top view of a border piece, according to one embodiment of this invention.

According to some embodiments of this invention, flap 40 is movable with respect to page 30 between the open position and the closed position. In the closed position, flap 40 is in or positioned within recess 32 of page 30. In the closed position, in some embodiments of this invention, structural element 50 is positioned within recess 42 and/or recess 33. In some embodiments of this invention, border 48 as shown in FIGS. 2, 4 and 6 is attached or secured to flap 40 to form recess 42, which can have any suitable dimension, depth or thickness. As flap 40 is moved to the open position, structural element 50 moves to a pop-up position, a pull-up position and/or an activated position, in which at least a portion of structural element 50 is raised above page 30 or a top surface of page 30. In other embodiments according to this invention, more than one structural element 50 can be attached to one page 30.

According to some embodiments of this invention, structural element 50 can have a bias force, such as a spring force that applies an opening force to flap 40 when in the closed position. Any other suitable structure can be used to apply a similar bias force or opening force to flap 40.

As shown in FIGS. 1-4, hinge 44 is used to movably connect or attach flap 40 with respect to page 30 and/or any other suitable element of book 20. In other embodiments of this invention, any other suitable hinge element, hinge structure and/or other structure, such as known to those skilled in the art of publishing and printing, that allows movement of flap 40 with respect to page 30, for example, can be used in addition to or in lieu of the arrangement of hinge 44 as shown in FIGS. 1-4. In other embodiments of this invention, flap 40 can be movably mounted with respect to page 30 in a sliding manner and/or in any other suitable structural arrangement that allows movement of flap 40 with respect to page 30.

In some embodiments of this invention, a magnet, which is not shown in the drawings, can be used to secure flap 40 with respect to page 30, for example, in the position as shown in FIG. 1, so that flap 40 does not inadvertently move, such as with respect to page 30. In some embodiments of this invention, an adhesive material, such as glue or another suitable low-tack adhesive, can be used to secure flap 40 with respect to page 30, for similar reasons. In other embodiments of this invention, any other suitable material and/or structural element, including but not limited to hook-and-loop fasteners, can be used to secure flap 40 with respect to page 30, again for similar reasons.

Figure 3:
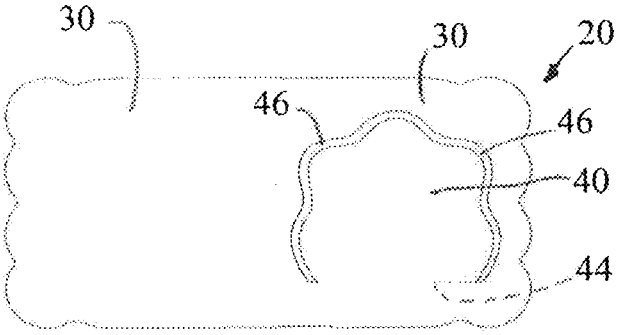
FIG. 3 is a top view of the book with the flap and the pop-up element, as shown in FIG. 1.

As shown in FIGS. 1 and 3, at least a portion of a gap, a void and/or a space between flap 40 and page 30 forms channel 46. In some embodiments of this invention, channel 46 is formed by a channel cut between flap 40 and page 30. Channel 46 can have any suitable shape, dimension and/or thickness. In some embodiments of this invention, a dimension of channel 46 is relatively large and thus allows flap 40 to move relatively easily with respect to page 30. In other embodiments of this invention, all or at least a portion of channel 46 can have a relatively small dimension which can make it more difficult to open flap 40 with respect to page 30. In still other embodiments of this invention, all or at least a portion of channel 46 forms an interference fit between flap 40 and page 30, for example, so that a fictional fit between flap 40 and page 30 can be used to maintain flap 40 in a closed position with respect to page 30.

According to some embodiments of this invention, a method for moving structural element 50 on page 30 of book 20 includes movably mounting flap 40, in any direction, between the open position and the closed position with respect to page 30, attaching structural element 50 to flap 40 and/or to page 30, so that in the closed position flap 40 is positioned in recess 32 of page 30 and in the closed position structural element 50 is positioned within recess 33 and/or recess 42. In some embodiments of this invention, moving flap 40 from the closed position to the open position moves structural element 50 into a pop-up position.

In the pop-up position, structural element 50 can extend above page 30 or can be raised above a surface of page 30. In the closed position, flap 40 can be flush mounted with respect to page 30. In the closed position, structural element 50 can be positioned within a thickness of page 30.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. A book comprising: a plurality of pages bound together forming the book, a first page of the pages having a first recess, a flap movable with respect to the first page between an open position and a closed position, the flap having a second recess, in the closed position the flap positioned in the first recess, a structural element attached to the flap and/or the page, in the closed position the structural element positioned within the first recess and/or the second recess, and the structural element moving to a pop-up position as the flap is moved into the open position.

2. The book according to claim 1, wherein the structural element is secured to the flap and to the first page.

3. The book according to claim 1, wherein in the closed position of the flap the structural element is completely positioned within the first recess and/or the second recess.

4. The book according to claim 1, wherein the flap is hingedly connected to the first page.

5. A book comprising: a plurality of pages bound together forming the book, a first page of the pages having a first recess, a flap movable with respect to the first page between an open position and a closed position, the flap having a second recess, in the closed position the flap positioned in the first recess, a structural element attached to the flap and/or the page, in the closed position the structural element positioned within the first recess and/or the second recess, and the structural element raising above the first page as the flap moves from the closed position to the open position.

6. A book comprising: a plurality of pages bound together forming the book, a first page of the pages having a first recess, a flap movable with respect to the first page between an open position and a closed position, the flap having a second recess, in the closed position the flap positioned in the first recess, a structural element attached to the flap and/or the page, in the closed position the structural element positioned within the first recess and/or the second recess, and in the closed position the structural element applying an opening force to the flap.

7. In a book having a plurality of pages bound together forming the book, the improvement comprising: at least one first page of the pages having a page recess, a flap movable with respect to the first page between an open position and a closed position, the flap having a flap recess, in the closed position the flap positioned within the page recess, a structural element attached to the flap and/or the page, in the closed position the structural element positioned within the page recess and/or the flap recess, and the structural element moving toward a pop-up position as the flap moving toward the open position.

8. In the book according to claim 7, wherein the structural element is secured to the flap and to the first page.

9. In the book according to claim 7, wherein in the closed position of the flap the structural element is completely positioned within the page recess and/or the flap recess.

10. In the book according to claim 7, wherein the flap is hingedly connected to the first page.

11. In a book having a plurality of pages bound together forming the book, the improvement comprising: at least one first page of the pages having a page recess, a flap movable with respect to the first page between an open position and a closed position, the flap having a flap recess, in the closed position the flap positioned within the page recess, a structural element attached to the flap and/or the page, in the closed position the structural element positioned within the page recess and/or the flap recess, and the structural element moving above the first page as the flap moves from the closed position to the open position.

12. In a book having a plurality of pages bound together forming the book, the improvement comprising: at least one first page of the pages having a page recess, a flap movable with respect to the first page between an open position and a closed position, the flap having a flap recess, in the closed position the flap positioned within the page recess, a structural element attached to the flap and/or the page, in the closed position the structural element positioned within the page recess and/or the flap recess, and in the closed position the structural element applying an opening force to the flap.

13. A method for moving a structural element on a page of a book, the method including:

movably mounting a flap between an open position and a closed position with respect to the page;

attaching a structural element to the flap and/or the page;

in the closed position positioning the flap in a page recess of the page;

in the closed position positioning the structural element within the page recess and/or a flap recess of the flap; and moving the flap from the closed position to the open position moves the structural element into a pop-up position.

14. The method according to claim 13, wherein in the pop-up position the structural element extends above the page.

15. The method according to claim 13, wherein in the closed position the flap is flushly mounted with respect to the page.

16. The method according to claim 13, wherein the structural element is secured to the page and to the flap.

17. The method according to claim 13, wherein in the closed position the structural element is positioned within a thickness of the page.

* * * * *